US006039207A

United States Patent [19]

Adamek

[11] Patent Number: 6,039,207

[45] Date of Patent: Mar. 21, 2000

[54] LIDDED INSULATOR FOR A BEVERAGE CONTAINER

[76] Inventor: Thad R. Adamek, 945 Duncan Rd., South Daytona, Fla. 32119

[21] Appl. No.: 09/118,114

[22] Filed: Jul. 17, 1998

[51] Int. Cl.[7] ..... B65D 25/00; B65D 25/30

[52] U.S. Cl. ..... 220/739; 215/303; 215/305; 220/740; 220/755; 220/756; 220/833; 220/837; 220/903; 220/914; 220/915.1

[58] Field of Search ..... 220/737, 739, 220/903, 740, 833, 837–839, 755, 756, 914, 915.1, DIG. 10; 224/148.1–148.4, 148.6, 148.7, 671, 674; 215/295, 305, 306, 298, 303

[56] References Cited

U.S. PATENT DOCUMENTS

| | | | |
|---|---|---|---|
| 175,811 | 4/1876 | Wright | 215/235 |
| D. 229,153 | 11/1973 | Moussette | D7/622 |
| D. 229,156 | 11/1973 | Moussette | D7/622 |
| 273,935 | 3/1883 | Bate | 215/235 |
| 444,702 | 1/1891 | Hartley | 220/846 |
| 1,589,771 | 6/1926 | Tucker | 220/375 |
| 2,488,854 | 11/1949 | Crane | 222/214 |
| 3,618,161 | 11/1971 | Nozawa | 220/838 X |
| 3,628,215 | 12/1971 | Everburg | 220/838 X |
| 3,738,529 | 6/1973 | Rose . | |
| 3,905,511 | 9/1975 | Groendal . | |
| 4,268,567 | 5/1981 | Harmony . | |
| 4,561,563 | 12/1985 | Woods . | |
| 4,577,474 | 3/1986 | Peterson . | |
| 4,640,424 | 2/1987 | White | 215/11.1 |
| 4,671,424 | 6/1987 | Byrns . | |
| 4,746,028 | 5/1988 | Bagg . | |
| 4,872,577 | 10/1989 | Smith . | |
| 4,927,047 | 5/1990 | Stuber et al. . | |
| 4,934,556 | 6/1990 | Kleissendorf | 220/269 |
| 5,048,734 | 9/1991 | Long . | |
| 5,058,757 | 10/1991 | Proa . | |
| 5,147,067 | 9/1992 | Effertz . | |
| 5,186,350 | 2/1993 | McBride | 220/903 X |
| 5,467,891 | 11/1995 | Perry . | |
| 5,564,583 | 10/1996 | Kelley et al. . | |
| 5,740,940 | 4/1998 | Weiss | 220/903 X |
| 5,740,951 | 4/1998 | Jack | 220/903 X |
| 5,799,811 | 9/1998 | Bruckner et al. | 215/10 X |

*Primary Examiner*—Allan N. Shoap
*Assistant Examiner*—Joe Merek
*Attorney, Agent, or Firm*—Paul S. Rooy

[57] ABSTRACT

A lidded insulator for a beverage container comprising an insulator lid hingedly attached to an insulator body by means of a hinge. An insulator top ring having an insulator top ring bore is attached to the insulator lid. The hinge is made of resilient material possessing material memory tending to urge the hinge into a straight position. This hinge material memory tends to urge the insulator lid into a closed position. The lidded insulator for a beverage container is sized to frictionally admit a standard sized beverage container. Thus the beverage container is held securely within the insulator body, and when the insulator lid is closed on the beverage container, the frictional fit between the insulator lid and the beverage container holds the top closed, and together with the hinge material memory, urges the insulator lid top into sealing relationship with the beverage container opening. An alternate embodiment is disclosed comprising a bullet lid hingedly attached to a cartridge body, and a rim at an extreme of the cartridge body opposite the bullet lid.

11 Claims, 3 Drawing Sheets

FIG 1
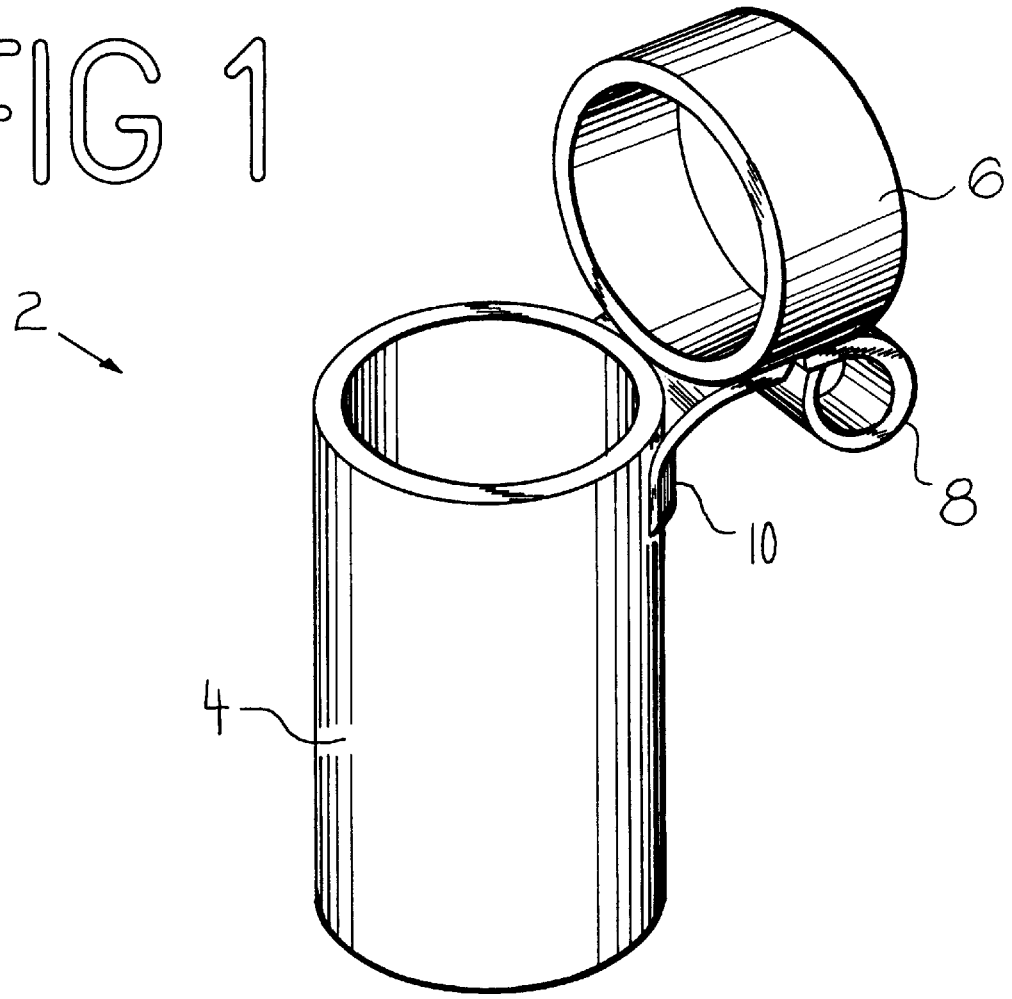
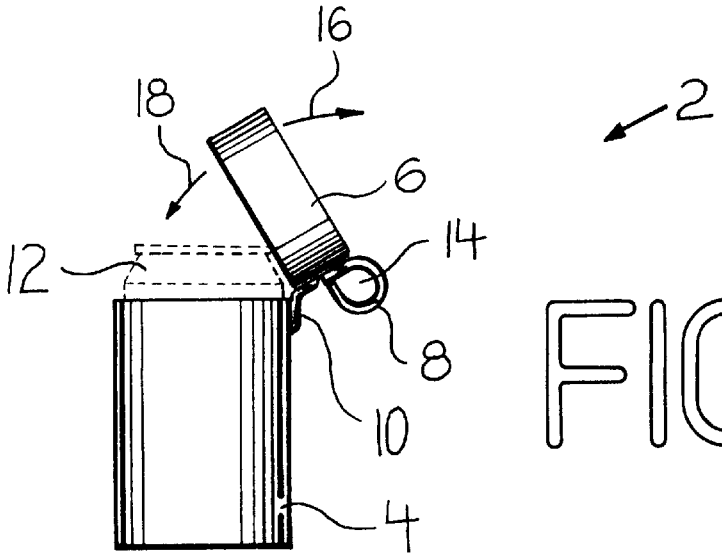
FIG 2

LIDDED INSULATOR FOR A BEVERAGE CONTAINER

BACKGROUND OF THE INVENTION

1. Field of the Invention

This invention relates to thermal containers, and in particular to a lidded cold cup.

2. Background of the Invention

Canned drinks have become the standard for individual serving sized drinks. Today's consumer can purchase a wide variety of drinks, ranging from soft drinks and fruit juices to alcoholic beverages, in standard sized, 12 oz. cans. These canned drinks may be procured individually from vending machines, or from merchants, generally in 6-pack, 12-pack or 24 unit case packages.

The cans in which these beverages are sold are generally made of thin aluminum or other appropriate metal. This type of thin metal generally conducts heat well, and so it becomes a problem to maintain the beverage at an appropriate temperature (generally chilled). This problem becomes especially acute where the beverage is being consumed in a hot climate. Absent some kind of insulation, it is difficult to finish the drink before it warms to a distastefully high temperature.

3. Existing Designs

A number of designs have been proposed which involve wrapping a layer of insulation around a can in order to insulate its contents from the outside temperature. A number of patents have been granted for this type of design, including U.S. Pat. No. 5,467,891 to Perry, U.S. Pat. No. 5,147,067 to Effertz, and U.S. Pat. No. 4,268,567 to Harmony. These designs all provided insulation to the sides of a cylindrical can, but not to its top.

There are a number of problems associated with not providing a top to a can insulation device. One problem is lack of insulation. A can loses a substantial amount of its interior temperature through its top. Applicant has determined that an insulated can top can keep the contents of a beverage can cold approximately 40% longer than a can whose top is uninsulated.

Another problem associated with not providing a can top is spillage. Where a tightly fitting can top is provided, spillage can be reduced and even eliminated completely if the can tips over. Still another problem associated with not providing a can top is bug or other foreign matter invasion. Occasionally a bug will crawl or fly into a beverage can, and then inadvertently end up in the consumer's mouth. This situation creates a sanitary hazard, and in the case of a poisonous bug, a safety hazard.

A number of patents have been granted for can insulators which incorporate caps. U.S. Pat. No. 5,058,757 was granted Proa for a can cooler with a retractable umbrella. While this design provided shade for the can for certain sun angles, the umbrella prevented neither spills nor bug incursion.

U.S. Pat. Nos. 4,561,563, 4,872,577 and 5,564,583 were granted Woods, Smith and Kelley et al. respectively. While these designs provided a removable can cooler top, they suffered from complexity of design, and thus were expensive. In addition, most of these designs (except for '563) made no provision for one-handed operation. Thus these designs (except for '563) were cumbersome to open and close. The '563 design was complex, and involved a pair of opposing doors spring-loaded into the closed position. This design suffered from the drawbacks of complexity and expense, and appeared difficult to clean.

U.S. Pat. No. 5,048,734 was granted Long for a cooler incorporating an insulated cover flap hingedly connected to a cylindrical body which could be retained in a closed position by means of a Velcro strip. While this design provided an insulated cover which could fit tightly over a can top, it was cumbersome to operate because to open the top, the consumer had to first peel the Velcro free of the cylindrical body, and then open the top, and hold it open while the beverage was being consumed, then close the top and press the Velcro strip down to hold the top closed. Thus, two-handed operation was required throughout the top opening, drinking, and the top closing steps, resulting in inconvenience and cumbersomeness.

Stuber et al. received U.S. Pat. No. 4,927,047 for a beverage insulator which incorporated a side handle, and a top held closed by means of a rubber band. The Stuber design was apparently made of rigid material, and thus did not seal tightly around the top of a can contained in it. The top incorporated a thumb-lever. Thus, the '047 design provided a top which could be opened single-handedly by an individual whose fingers were holding the container by its handle, and whose thumb was in contact with the thumb lever.

This design suffered from a number of problems. If the rubber band broke, not only would the top not stay closed, but it would fall off the insulator completely. In areas of high sunlight, where one would typically use a can insulator, ultraviolet radiation severely limits the life of a rubber band due to solar embrittlement. Thus the reliability of this design is severely compromised by its rubber band weak link. And where the rubber band failed at an inopportune time, the top could be irretrievable lost.

Another problem associated with the '047 design is the lack of a tight seal between a beverage container contained in it and the insulator top. If the insulator were to tip over, liquid contained in the beverage container would not be contained, and would spill out through the crack between the top and the insulator.

Another drawback associated with the '047 design is its top thumb lever design. In order to open the top, the consumer must introduce at least one or two fingers through the handle, and then use his thumb on the top thumb lever to open the top. If the '047 design lacked a handle, the top opening scheme wouldn't work. Thus in order to function, this design required an insulator handle, thus contributing to its complexity and expense.

SUMMARY OF THE INVENTION

Accordingly, it is an object of the present invention to provide a lidded insulator for a beverage container which provides increased insulation. Design features allowing this object to be accomplished include an insulator lid hingedly attached to an insulator body. Advantages associated with the accomplishment of this object include the ability to keep a beverage cold approximately 40% longer than if a lid-less insulator were to be used.

It is another object of the present invention to provide a lidded insulator for a beverage container which prevents bugs and other foreign material from entering the beverage container. Design features allowing this object to be accomplished include an insulator lid hingedly attached to an insulator body. Benefits associated with the accomplishment of this object include increased sanitation and hygiene, especially in the case of poisonous bugs, and a more relaxed state of mind on the part of the consumer.

It is still another object of this invention to provide a lidded insulator for a beverage container which is capable of sealing a beverage container if the beverage container falls over. Design features enabling the accomplishment of this object include an insulator lid having an insulator lid top which is spring-loaded into contact with the top of a beverage container, and held there over the beverage container opening by means of friction between a lid wall and the beverage container wall. Advantages associated with the realization of this object include avoidance of messy spills and prevention of beverage waste.

It is another object of the present invention to provide a lidded insulator for a beverage container which may be opened and closed using only one hand. Design features allowing this object to be accomplished include an insulator lid hingedly attached to an insulator body, and an insulator top ring having an insulator top ring bore attached to the insulator top. Benefits associated with the accomplishment of this object include convenience and safety of operation, especially where the beverage is being consumed while the consumer is engaged in some other task requiring use of the other hand.

It is still another object of this invention to provide a lidded insulator for a beverage container whose top is spring-loaded closed. Design features enabling the accomplishment of this object include an insulator lid attached to an insulator body by means of a resilient hinge. Advantages associated with the realization of this object include automatic closure when the lidded insulator for a beverage container is released, and more secure closure when the lid is manually placed in the closed position.

It is another object of the present invention to provide a lidded insulator for a beverage container capable of holding a beverage container which is taller and thinner than average, yet providing a lidded insulator for a beverage container which is aesthetically pleasing in appearance. Design features allowing this object to be accomplished include a bullet lid hingedly attached to a cartridge. Benefits associated with the accomplishment of this object include being able to maintain a tall and thin beverage container cold, and a tasteful and novel aesthetic appearance.

It is still another object of this invention to provide a lidded insulator for a beverage container capable of holding a beverage container which is taller and thinner than average, yet do so with security so as to prevent the lidded insulator for a beverage container from tipping over. Design features enabling the accomplishment of this object include a bullet lid hingedly attached to a cartridge body having a body rim. Advantages associated with the realization of this object include greater tip resistance in the lidded insulator for a beverage container, and a tasteful and novel aesthetic appearance.

It is yet another object of this invention to provide a lidded insulator for a beverage container which is easy and inexpensive to make. Design features allowing this object to be achieved include the use of components made of readily available, inexpensive materials. Benefits associated with reaching this objective include reduced cost, and hence increased availability.

BRIEF DESCRIPTION OF THE DRAWINGS

The invention, together with the other objects, features, aspects and advantages thereof, will be more clearly understood from the following in conjunction with the accompanying drawings.

Three sheets of drawings are provided. Sheet one contains FIGS. 1 and 2. Sheet two contains FIGS. 3 and 4. Sheet three contains FIG. 5.

FIG. 1 is a quarter side isometric view of a lidded insulator for a beverage container.

FIG. 2 is a side isometric view of a lidded insulator for a beverage container in the open position.

DETAILED DESCRIPTION OF THE PREFERRED EMBODIMENT

Figure 3:
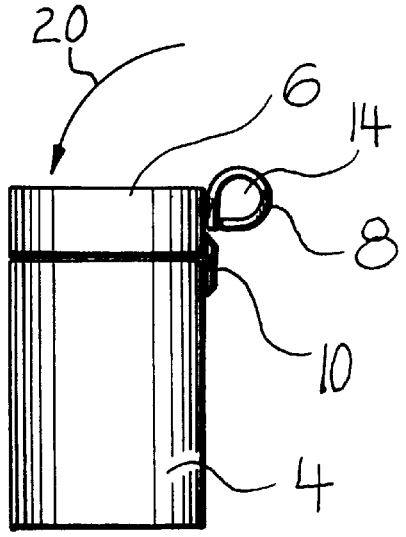
FIG. 3 is a side isometric view of a lidded insulator for a beverage container in the closed position.

Referring now to FIG. 1 we observe a quarter side isometric view of lidded insulator for a beverage container 2. Lidded insulator for a beverage container 2 comprises insulator lid 6 hingedly attached to insulator body 4 by means of resilient hinge 10. Insulator lid 6 further comprises insulator top ring 8 attached to insulator lid 6. Insulator lid top ring 8 comprises insulator top ring bore 14 sized to admit a finger or thumb of a consumer, thus enabling the consumer to grip insulator body 4 with one hand, and using a single digit of that same hand, open and close insulator lid 6.

FIG. 2 is a side isometric view of lidded insulator for a beverage container 2 with insulator lid 6 in the open position. As may be observed in FIG. 4, insulator body 4 comprises cylindrical insulator body wall 26 attached to insulator body floor 28. Insulator body wall 26 is sized to frictionally admit beverage container 12. In this fashion, a beverage container 12 inserted into lidded insulator for a beverage container 2 will be held securely in place by virtue of the frictional fit between insulator body wall 26 and beverage container wall 36.

As may be observed in FIG. 2, while gripping insulator body 4 with one hand, a consumer can insert one digit of that same hand through insulator top ring bore 14, and single-handedly open insulator lid 6 of lidded insulator for a beverage container 2 as indicated by arrow 16, or in the alternative, close insulator lid 6 of lidded insulator for a beverage container 2 as indicated by arrow 18.

Figure 4:
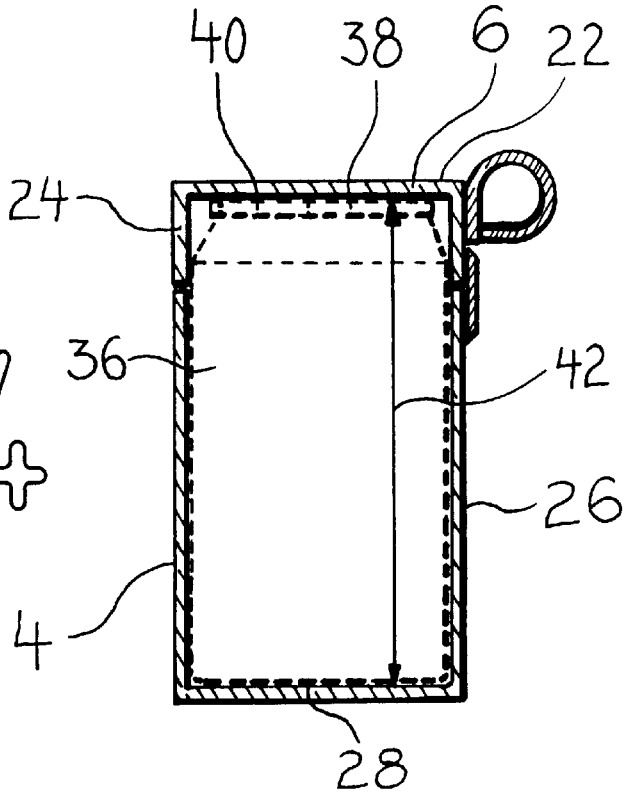
FIG. 4 is a side cross-sectional view of a lidded insulator for a beverage container in the closed position.

FIG. 3 is a side isometric view of lidded insulator for a beverage container 2 in the closed position. Insulator lid 6 has been closed over beverage container 12 as indicated by arrow 20. Referring now also to FIG. 4, insulator lid 6 comprises cylindrical lid wall 24 attached to lid top 22. Lid wall 24 is sized to frictionally admit beverage container wall 36. In this fashion, when insulator lid 6 is closed over a beverage container 12 contained within lidded insulator for a beverage container 2, insulator lid 6 will be held securely in place by virtue of the frictional fit between lid wall 24 and beverage container wall 36.

In addition, lidded container internal height 42 is sized so that when insulator lid 6 is in the closed position, as is depicted in FIG. 4, lid top 22 is held tightly against beverage container top 38, thus sealing lid top 22 over beverage container opening 40. Thus, in the eventuality lidded insulator for a beverage container 2 containing a beverage container 12 tips over, the tight fit between lid top 22 and beverage container opening 40 will minimize any beverage spillage.

Figure 5:
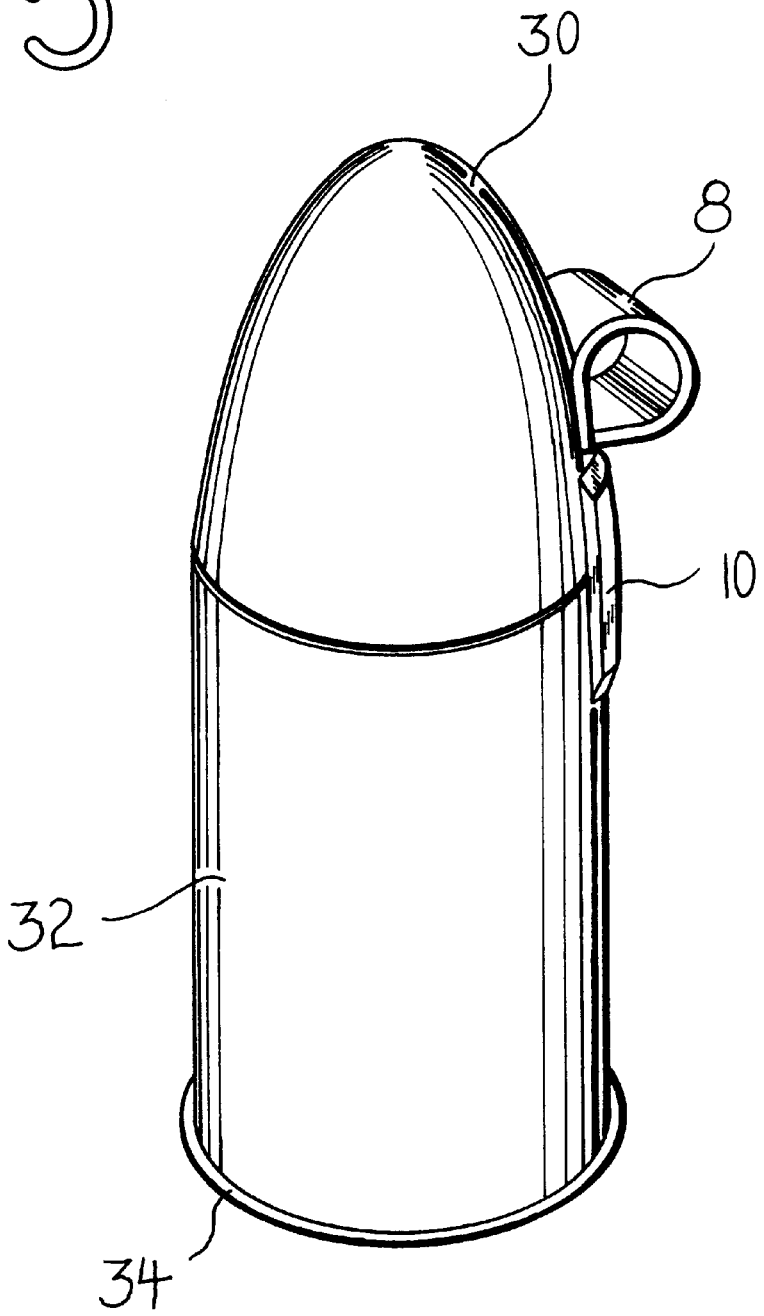
FIG. 5 is a quarter side isometric view of an alternate embodiment lidded insulator for a beverage container comprising a bullet lid and a cartridge body having a body rim.

Hinge 10 is made of resilient material, possessing material memory which urges hinge 10 to return to a straight position as is depicted in FIGS. 3, 4 and 5. Thus, the memory inherent in the material from which hinge 10 is made urges insulator lid 6 into the closed position. Therefore, not only does the frictional fit between lid wall 24 and beverage container wall 36 help hold lid top 22 against beverage container opening 40, but the resilient nature of the hinge 10 material also helps lid top 22 seal beverage container opening 40.

FIG. 5 is a quarter side isometric view of alternate embodiment lidded insulator for a beverage container 2 comprising bullet lid 30 hingedly attached to cartridge body 32 by means of hinge 10.

The shape of bullet lid 30 when viewed from a side is the top half of an oval. Bullet lid 30 comprises insulator top ring 8, which serves to permit the single-handed opening and closing of bullet lid 30, as described above in connection with the preferred embodiment.

Cartridge body 32 comprises body rim 34 disposed at an extreme of cartridge body 32 opposite bullet lid 30. Body rim 34 is annular in shape, and serves two purposes. The first purpose for body rim 34 is to increase the footprint of the alternate embodiment lidded insulator for a beverage container 2 depicted in FIG. 5, thus increasing its stability and resistance to tipping. The second purpose for body rim 34 is aesthetic—it helps make the alternate embodiment lidded insulator for a beverage container 2 shown in FIG. 5 resemble a bullet.

In the preferred embodiment, lidded insulator for a beverage container 2 was manufactured of foam rubber or other appropriate resilient insulating material.

While a preferred embodiment of the invention has been illustrated herein, it is to be understood that changes and variations may be made by those skilled in the art without departing from the spirit of the appending claims.

DRAWING ITEM INDEX

| | |
|---|---|
| 2 | lidded insulator for a beverage container |
| 4 | insulator body |
| 6 | insulator lid |
| 8 | insulator top ring |
| 10 | hinge |
| 12 | beverage container |
| 14 | insulator top ring bore |
| 16 | arrow |
| 18 | arrow |
| 20 | arrow |
| 22 | lid top |
| 24 | lid wall |
| 26 | insulator body wall |
| 28 | insulator body floor |
| 30 | bullet lid |
| 32 | cartridge body |
| 34 | body rim |
| 36 | beverage container wall |
| 38 | beverage container top |
| 40 | beverage container opening |
| 42 | lidded container internal height |

I claim:

1. A lidded insulator for a beverage container comprising an insulator lid hingedly attached to an insulator body by means of a hinge, said insulator lid comprising an insulator top ring attached to an exterior side wall of said insulator lid, said insulator top ring having an insulator top ring bore, an axis of symmetry of said insulator top ring bore being substantially parallel to a line tangent to said insulator lid exterior wall and substantially perpendicular to an axis of symmetry of said beverage container, whereby a consumer may grip said insulator body with one hand, introduce at least one digit of said hand into said insulator top ring bore, and open or close said insulator lid using only one hand.

2. The lidded insulator for a beverage container of claim 1 wherein said hinge is made of resilient material, whereby memory inherent in said resilient material tends to urge said hinge into a straight position, thereby spring-loading said insulator lid into a closed position.

3. The lidded insulator for a beverage container of claim 1 wherein said insulator lid comprises a cylindrical lid wall attached to a lid top, and wherein said insulator body comprises a cylindrical insulator body wall attached to an insulator body floor.

4. The lidded insulator for a beverage container of claim 3 wherein said insulator body wall and said lid wall are sized to frictionally admit a cylindrical beverage can of substantially twelve ounce capacity.

5. The lidded insulator for a beverage container of claim 4 wherein a lidded insulator internal height of said lidded insulator for a beverage container is sized such that said lid top is urged tightly against a beverage container top of a beverage container disposed within said lidded insulator for a beverage container, when said insulator lid is in a closed position, thereby sealing a beverage container opening disposed in said beverage container top from spillage.

6. An alternate embodiment lidded insulator for a beverage container comprising a bullet lid hingedly attached to a cylindrical cartridge body by means of a hinge, a shape of said bullet lid being a top half of an oval when viewed from a side, said bullet lid comprising an insulator top ring attached to an exterior side wall of said bullet lid; said insulator top ring having an insulator top ring bore, an axis of symmetry of said top ring bore being substantially parallel to a line tangent to said bullet lid exterior wall and substantially perpendicular to an axis of symmetry of said beverage container, whereby a consumer may grip said cartridge body with one hand, introduce at least one digit of said hand into said insulator top ring bore, and open or close said bullet lid using only one hand.

7. The alternate embodiment lidded insulator for a beverage container of claim 6 wherein said cartridge body further comprises a body rim disposed at an extreme of said cartridge body opposite said bullet lid, said body rim enhancing an aesthetic appeal of said alternate embodiment lidded insulator for a beverage container, said body rim increasing a stability of said alternate embodiment lidded insulator for a beverage container and rendering it resistant to tipping.

8. A lidded insulator for a beverage container comprising an insulator lid hingedly attached to an insulator body by means of a hinge, said hinge being made of resilient material whereby memory inherent in said resilient material tends to urge said hinge into a straight position, thereby spring-loading said insulator lid into a closed position, said insulator lid comprising an insulator top ring attached to an exterior side wall of said insulator lid; said insulator lid top ring having an insulator top ring bore, an axis of symmetry of said top ring bore being substantially parallel to a line tangent to said insulator lid exterior wall and substantially perpendicular to an axis of symmetry of said beverage container, whereby a consumer may grip said insulator body with one hand, introduce at least one digit of said hand into said insulator top ring bore, and open or close said insulator lid using only one hand.

9. The lidded insulator for a beverage container of claim 8 wherein said insulator lid comprises a cylindrical lid wall attached to a lid top, and wherein said insulator body comprises a cylindrical insulator body wall attached to an insulator body floor.

10. The lidded insulator for a beverage container of claim 9 wherein said insulator body wall and said lid wall are sized to frictionally admit a cylindrical beverage can of substantially twelve ounce capacity.

11. The lidded insulator for a beverage container of claim 10 wherein a lidded insulator internal height of said lidded insulator for a beverage container is sized such that said lid top is urged tightly against a beverage container top of a beverage container disposed within said lidded insulator for a beverage container, when said insulator lid is in a closed position.

* * * * *